US008382490B2

(12) United States Patent
Miyamoto et al.

(10) Patent No.: US 8,382,490 B2
(45) Date of Patent: Feb. 26, 2013

(54) ELECTRICAL JUNCTION BOX

(75) Inventors: Takashi Miyamoto, Yokkaichi (JP); Takamasa Kubota, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 13/221,254

(22) Filed: Aug. 30, 2011

(65) Prior Publication Data

US 2012/0135614 A1 May 31, 2012

(30) Foreign Application Priority Data

Nov. 30, 2010 (JP) ..... 2010-267476

(51) Int. Cl.
*H01R 12/00* (2006.01)

(52) U.S. Cl. ..... 439/76.2

(58) Field of Classification Search ..... 439/76.2, 439/76.1, 79, 80, 934
See application file for complete search history.

(56) References Cited

U.S. PATENT DOCUMENTS

| | | | | |
|---|---|---|---|---|
| 6,045,391 | A * | 4/2000 | Jaag | 439/405 |
| 6,050,845 | A * | 4/2000 | Smalley et al. | 439/417 |
| 7,901,238 | B1 * | 3/2011 | Muir et al. | 439/417 |
| 2011/0039422 | A1 * | 2/2011 | Muir et al. | 439/65 |

FOREIGN PATENT DOCUMENTS

| | | |
|---|---|---|
| JP | 9-163555 | 6/1997 |
| JP | 2000-295736 | 10/2000 |

* cited by examiner

*Primary Examiner* — Neil Abrams
*Assistant Examiner* — Phuongchi Nguyen
(74) *Attorney, Agent, or Firm* — Greenblum & Bernstein P.L.C.

(57) ABSTRACT

An object of the present invention is to provide an electrical junction box having a new structure that can simplify a parts control and can lower a cost in production by enabling already available connecting terminals to be converted. Support projections are provided on an insulation plate. The support projections receive and support connecting terminals and have projecting dimensions corresponding to the connecting terminals. A casing contains the insulation plate. The casing is provided on a surface opposed to the support projections with recess-like or bump-like matching portions that contact with projection end surfaces of the support projections to position the support projections.

2 Claims, 7 Drawing Sheets

ELECTRICAL JUNCTION BOX

CROSS-REFERENCE TO RELATED APPLICATIONS

The present application claims priority under 35 U.S.C. §119 of Japanese Application No. 2010-267476, filed on Nov. 30, 2010, which is herein expressly incorporated by reference in its entirety.

TECHNICAL FIELD

This invention relates to an electrical junction box, and more particularly relates to an electrical junction in which connecting terminals protruding from an insulation plate project outward from a casing.

BACKGROUND ART

Heretofore, an electrical junction box has been known in which an insulation plate is contained in a casing and connecting terminals protrude from the insulation plate. Such electrical junction box has been disclosed in, for example, JP HEI 9(1997)-163555 A and JP 2000-295736 A. In the electrical junction box, the connecting terminals that protrude from the insulation plate extend outward from the casing through terminal-receiving holes provided in a bottom wall of an electrical component-mounting section that is open in a surface of the casing. The connecting terminals are connected to electrical components such as connectors.

It is necessary to precisely set a projecting dimension of each connecting terminal from the casing to be a desired size in order to ensure a connection between the connecting terminals and mating electrical components. Accordingly, in the prior art, each connecting terminal having a necessary projecting dimension in length is newly designed in accordance with a specification of each electrical component and the projecting dimension can be obtained.

However, such structure must newly produce connecting terminals every time when an electrical junction box that contains electrical components having different specifications are newly produced. This will invite an increase of kinds of connecting terminals, will require time and effort in a parts control such as addition of a parts number and will increase a cost in production.

Accordingly, it will be contemplated that already available connecting terminals to be made in an already-existing production line are converted to an electrical junction box to be newly produced. However, it will be apparent from JP HEI 9(1997)-163555 A and JP 2000-295736 A that the insulation plate is provided with support projections that receive and support the connecting terminals. A dimension in height of each support projection must be set to be a given size in correspondence with a length of each connecting terminal in order to stably support the connecting terminal. Accordingly, if an insulation plate includes the support projections with projection heights corresponding to the already available connecting terminals and the insulation plate is applied to a new electrical junction box as it is, the support projections will interfere with a casing, a desired projecting dimension of each connecting terminal cannot be obtained, the connecting terminals cannot be stably supported on the casing under a projection state of the connecting terminals from the casing on account of the fact that the support projections are spaced excessively apart from the casing and are shifted from the casing. This will make it difficult to stably support the connecting terminals under the projection state of the connecting terminals from the casing.

In particular, in the case where the sheathed wire is arranged on the insulation plate and is pressed by insulation displacement terminal portions provided on proximal ends of the connecting terminals, it is not possible to alter a pressing position of only any connecting terminal, since the pressing positions of the insulation displacement terminal portions onto the sheathed wire are set to be not variable on the insulation plate. Therefore, in the prior art structure, it is difficult to convert the already available connecting terminals to new connecting terminals so that the projecting dimensions of the new connecting terminals from the casing become variable. Consequently, there has been no proposal in the prior art except that connecting terminals having different lengths corresponding to the specifications of electrical components to be connected to the terminals must be produced individually.

DISCLOSURE OF THE INVENTION

Problems that the Invention is to Solve

In view of the above problems, an object of the present invention is to provide an electrical junction box having a new structure that can simplify a parts control and can lower a cost in production by enabling already available connecting terminals to be converted.

Means for Solving the Problems

A first aspect of the present invention is directed to an electrical junction box wherein a plurality of connecting terminals protrude from an insulation plate, said insulation plate is contained in a casing, the connecting terminals protrude outward from the casing through terminal-receiving holes provided in the casing. The insulation plate is provided with support projections having projecting dimensions in correspondence with the connecting terminals. The connecting terminals are fitted into and held in the support projections. The casing is provided on a surface opposed to the support projections with recess-like or bump-like matching portions that contact with projection end surfaces of the support projections to position the support projections.

According to the electrical junction box in the first aspect of the present invention, since the contact positions between the support projections and the matching portions are adjusted while the support projections are set to be the projecting dimensions corresponding to the connecting terminals to stably support the connecting terminals, it is possible to adjust the projection amounts of the connecting terminals from the casing. That is, in the case where the support projections interfere with the casing and thus the projection amounts of the connecting terminals from the casing cannot be obtained, it is possible to obtain great projection amounts of the connecting terminals from the casing by forming the recess-like matching portions and inserting the support projections into the casing. On the other hand, in the case where the support projections are excessively spaced apart from the casing when the projection amounts of the support projections from the casing are small and the projection amounts of the connecting terminals from the casing are set to protrude outward from the casing, it is possible to support the connecting terminals while restraining the support projections and casing from being shifted with respect to each other by forming the bump-like matching portions and approaching the support projections to the casing. Thus, it is possible to readily alter the projection amounts of the connecting terminals from the casing, to set the projection amounts precisely and stably, to convert the already-existing connecting terminals produced on the already available production line to new connecting terminals.

A second aspect of the present invention is directed to the electrical junction box according to the first aspect. In the electrical junction box in the second aspect, a sheathed wire is arranged on the insulation plate. The connecting terminals are provided on proximal ends with insulation displacement terminal portions. The sheathed wire is pressed onto the insulation displacement terminal portions.

According to the electrical junction box in the second aspect of the present invention, it is possible to suitably alter and set the projection amounts of the connecting terminals from the casing without altering the pressing position of the connecting terminals for the sheathed wire on the insulation plate merely by adjusting a depth of each recess-like matching portion or a height of each bump-like matching portion on the insulation plate. Consequently, it is possible to set the projection amounts of the connecting terminals from the casing in correspondence with the specification of the electrical component to be connected to the connecting terminals without involving a design change of the insulation plate by utilizing the already available insulation plate and connecting terminals.

Effects of the Invention

According to the present invention, the support projections having projecting dimensions in height corresponding to the connecting terminals are provided on the insulation plate. The connecting terminals are fitted into and supported in the support projections. The casing is provided on the surface opposed to the support projections with the recess-like or bump-like matching portions with which the projection end surface of the support projections contact. Thus, it is possible to avoid an interference between the support projections and the casing and an excessive spacing between them, and to precisely and stably set the projection amounts of the connecting terminals from the casing by utilizing the already available connecting terminals. In result, it is possible to restrain the number of parts from increasing, to prevent an addition of parts number control, and to lower a cost in production.

BRIEF EXPLANATION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein.

PREFERRED ASPECTS OF EMBODYING THE INVENTION

Figure 1:
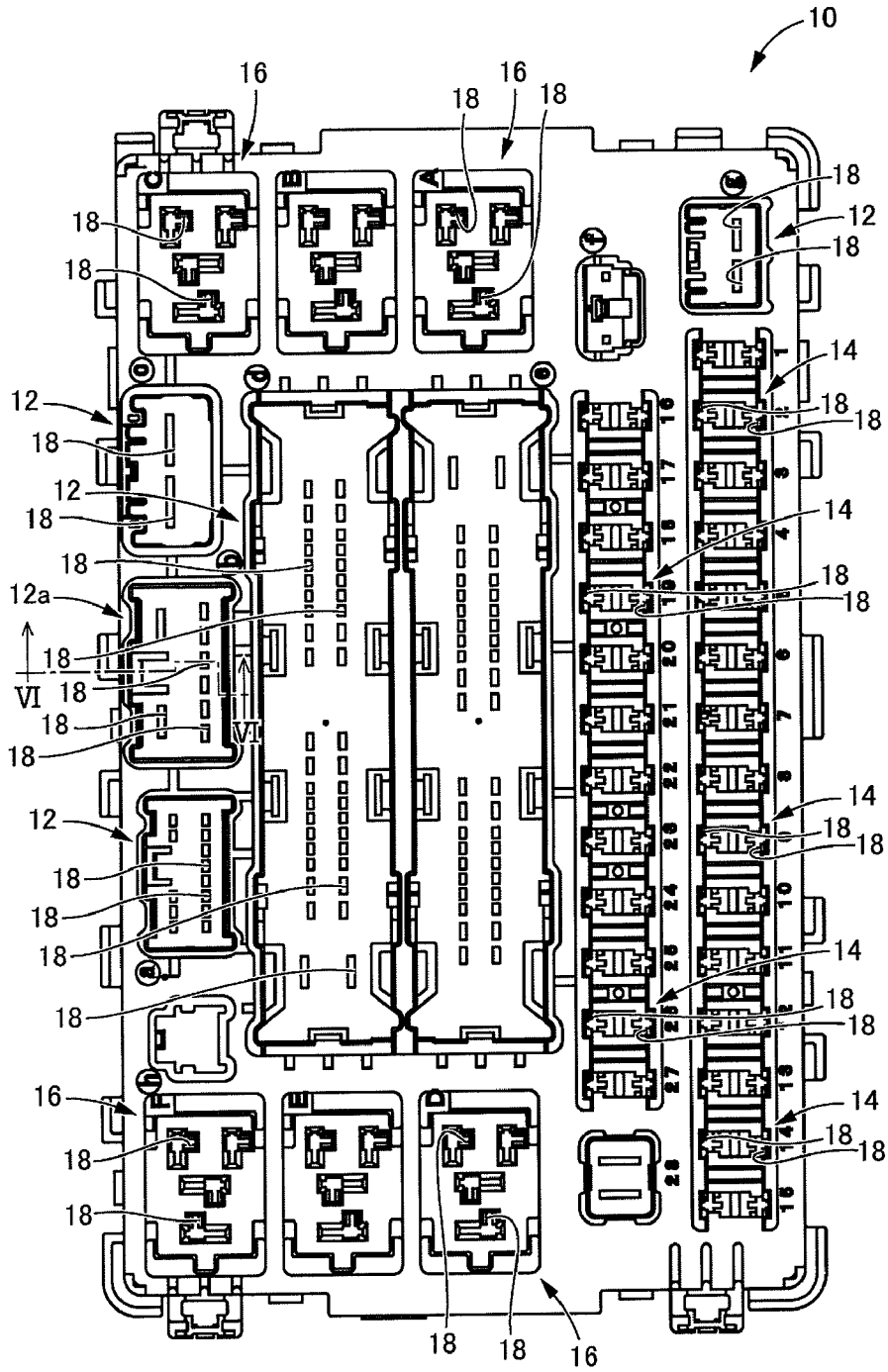
FIG. 1 is a plan view of a first embodiment of an upper casing that constitutes a part of an electrical junction box of the present invention, illustrating an outer surface of the upper casing.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Referring now to the drawings, embodiments of an electrical junction box in accordance with the present invention will be described below.

Figure 2:
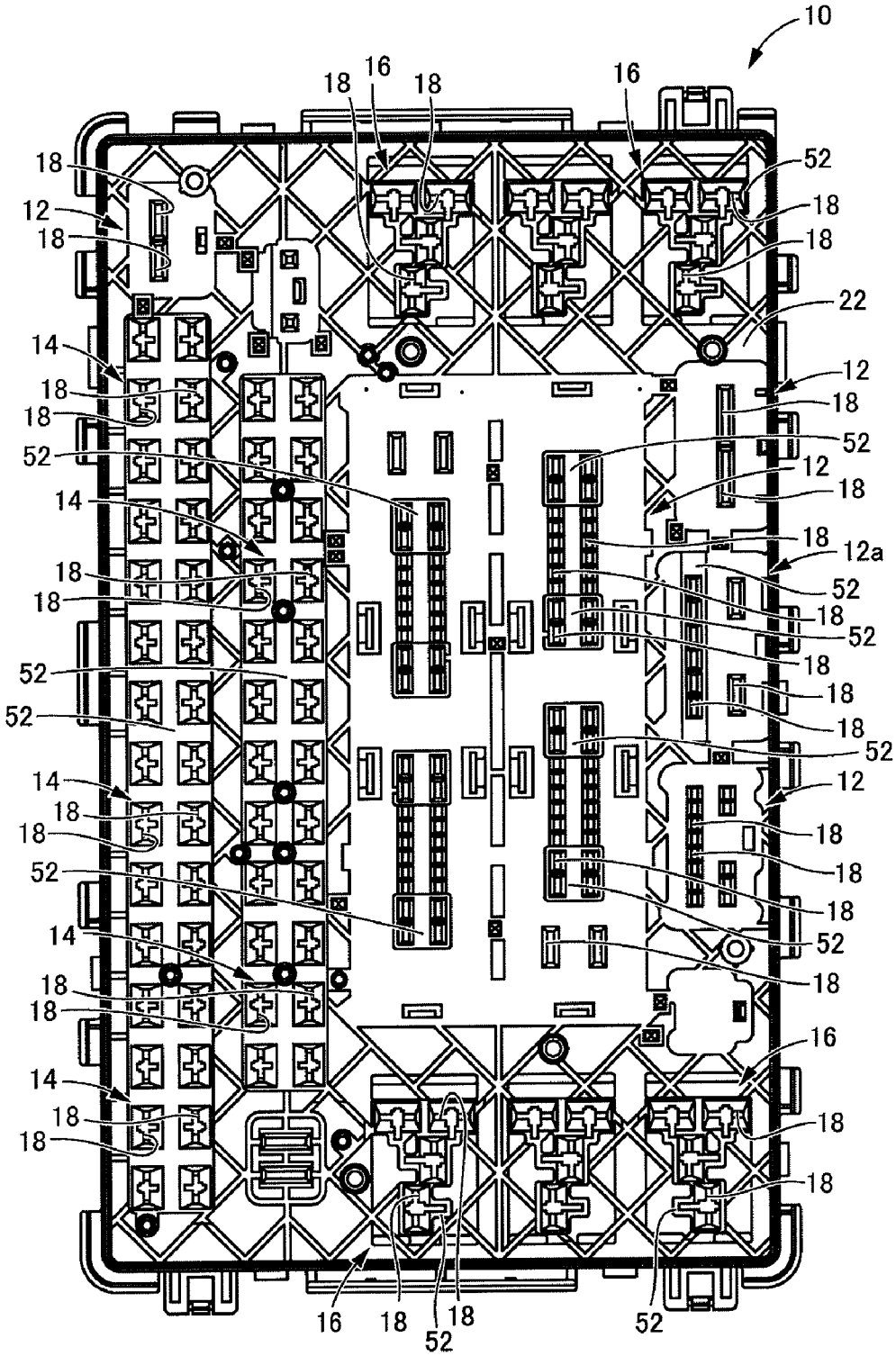
FIG. 2 is a plan view of the upper casing shown in FIG. 1, illustrating an inner surface of the upper casing.

FIG. 1 shows an outer surface of an upper casing 10 that constitutes a part of an electrical junction box in a first embodiment of the present invention while FIG. 2 shows an inner surface of the upper casing 10. The upper casing 10 is made of a synthetic resin or other suitable material and is formed into a casing body that is open at the side of a lower casing (not shown).

As known in the prior art, the upper casing 10 is provided with connector-mounting sections 12, fuse-mounting sections 14, relay-mounting sections 16, and the like. The mounting sections 12, 14, and 16 are provided with terminal-receiving holes 18 that penetrate the upper casing 10 in correspondence with configurations of tab-like terminals 28*a*, pin-like terminals 28*b*, and tuning fork-like terminals 28*c*. These terminals 28*a* to 28*c* serve as connecting terminals and will be described after.

Figure 3:
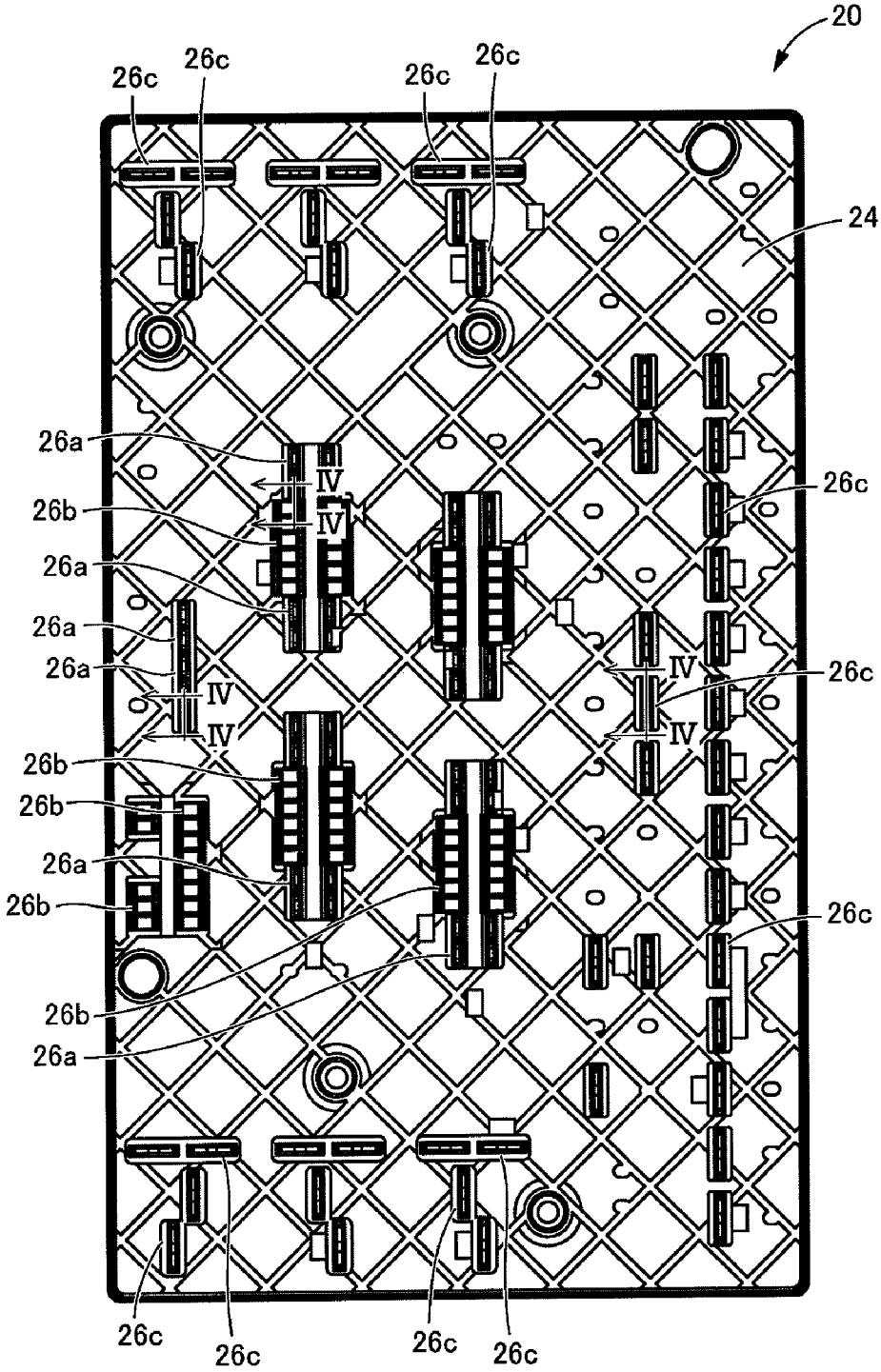
FIG. 3 is a plan view of an insulation plate to be contained in the upper casing shown in FIG. 1.
Figure 4:
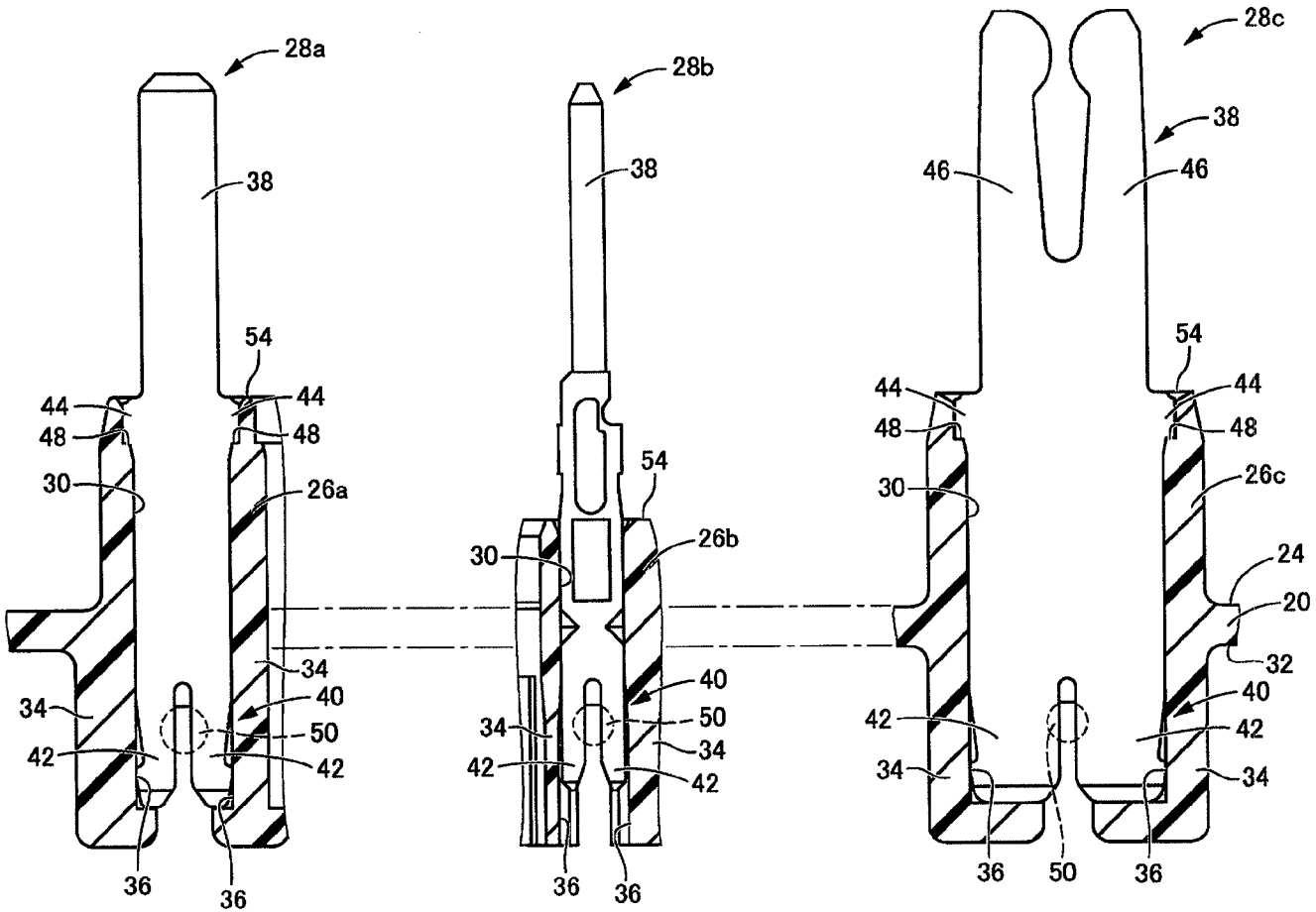
FIG. 4 is section views at three positions taken along lines IV-IV in FIG. 3.

An insulation plate 20 shown in FIG. 3 is contained in a space between the upper casing 10 and a lower casing (not shown). The insulation plate 20 is formed into a substantially plate-like configuration made of a synthetic resin or other suitable material. Support projections 26*a*, 26*b*, and 26*c* are integrated with a front side 24 of the insulation plate 20 that is opposed to the inner surface of the upper casing 10. FIG. 4 shows three support projections 26*a*, 26*b*, and 26*c* in FIG. 3, although the insulation plate 20 among the support projections is omitted in FIG. 4. The tab-like terminals 28*a*, pin-like terminals 28*b*, and tuning fork-like terminals 28*c* that serve as the connecting terminals are fitted into the support projections 26*a*, 26*b*, and 26*c*, respectively. In the case where it is not necessary to distinguish the support projections 26*a* to 26*c*, these projections 26*a* to 26*c* will be referred to as support projections 26 hereinafter.

The support projections 26 are formed into substantially rectangular tube-like configurations that protrude toward the upper casing 10 (upward in FIG. 4). The support projections 26 are provided in their central parts with through-holes 30 that penetrate the insulation plate 20.

Figure 5:
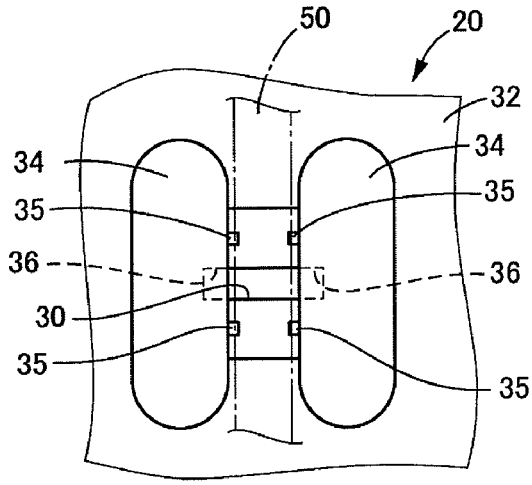
FIG. 5 is an enlarged plan view of a main part of the insulation plate shown in FIG. 3, illustrating the rear side of the insulation plate.

Three pairs of pinching projections 34, 34; 34, 34; 34, 34 that protrude from a rear side 32 of the insulation plate 20 are integrated with the insulation plate 20 at the side opposite from the support projections 26. Each pair of pinching projections 34, 34 are formed into projection configurations that protrude toward the lower casing (downward in FIG. 4) from the rear side 32. As shown in FIG. 5, the pinching projections 34, 34 are spaced apart from and opposed to each other by a given distance. A minimum dimension in distance between the opposed pinching projections 34 and 34 is set to be slightly smaller than an outer diameter of a sheathed wire 50 (mentioned after). In the first embodiment, the pinching projections 34, 34 are provided on their opposed surfaces with two pairs of pinching ribs 35, 35; 35, 35 that protrude toward each other to extend from the rear sides 32, 32 of the pinching projections 34, 34. Each pair of pinching ribs 35, 35 are disposed on both sides of the through-hole 30 on each pinching projection 34. A minimum dimension between the opposed pinching projections 34, 34 is set in accordance with a dimension between the opposed pinching ribs 35, 35 provided on the pinching projections 34, 34. Furthermore, the pinching projections 34, 34 are provided with insulation displacement terminal portion-receiving grooves 36, 36 that are open in the opposed surfaces of the pinching projections 34, 34 and are continued to the through-hole 30.

As shown in FIG. 4, the tab-like terminals 28*a*, pin-like terminals 28*b*, and tuning fork-like terminals 28*c* that serve as the connecting terminals are fitted into the support projections 26*a*, 26*b*, and 26*c* of the insulation plate 20, respectively. In the case where it is not necessary to distinguish the tab-like terminals 28*a*, pin-like terminals 28*b*, and tuning fork-like terminals 28*c*, they are referred to as the connecting terminals 28, hereinafter. Each connecting terminal 28 is provided on its distal end with a terminal portion 38 and on its proximal end with an insulation displacement terminal portion 40.

Each tab-like terminal 28*a* is formed by punching out a metal sheet, or by another suitable process. The terminal portion 38 of the tab-like terminal 28*a* is a tab-like configuration having a longitudinal rectangular flat shape in cross section. On the other hand, the insulation displacement terminal portion 40 of the tab-like terminal 28*a* has a pair of insulation displacement blades 42, 42 that are spaced apart from and opposed to each other. Furthermore, the tab-like terminal 28*a* is provided with projecting piece-like stoppers 44, 44 between the terminal portion 38 and the insulation displacement terminal portion 40.

On the other hand, Each pin-like terminal 28*b* is formed by punching out and bending a metal sheet, or by another suitable process. The terminal portion 38 of the pin-like terminal 28*b* is formed into a pin-like configuration that has a smaller dimension in width (dimension in right and left directions in FIG. 4) than that of the tab-like terminal 28*a*. Although the insulation displacement terminal portion 40 of the pin-like terminal 28*b* is not illustrated in detail in FIG. 4, the insulation displacement terminal portion 40 of the pin-like terminal 28*b* is provided with a U-shaped groove that extends in a longitudinal direction of the terminal portion 38. The U-shaped groove is formed between the insulation displacement blades 42, 42 so that projection pieces protruding outward from the blades 42, 42 extend upward vertically in a direction approaching to each other (upper and lower directions in FIG. 4).

Each tuning fork-like terminal 28*c* is formed by punching out a metal sheet, or by another suitable process. The terminal portion 38 of the tuning fork-like terminal 28*c* includes a pair of insulation displacement terminal blades 46, 46 that are spaced apart from each other so as to form a so-called tuning fork-like configuration. On the other hand, the insulation displacement terminal portion 40 includes a pair of insulation displacement blades 42, 42, as is the case with tab-like terminal 28*a*. The stoppers 44, 44 are also provided on the tuning fork-like terminal 28*c*, as is the case with the tab-like terminal 28*a*.

Already available connecting terminals, which are produced for electrical junction boxes that are different from that of the first embodiment and are ready for a producing line, may be converted to the tab-like terminals 28*a*, pin-like terminals 28*b*, and tuning fork-like terminals 28*c*.

The tab-like terminals 28*a*, pin-like terminals 28*b*, and tuning fork-like terminals 28*c* are inserted into the support projections 26*a*, 26*b*, and 26*c*, respectively. These terminals 28 are inserted into the through-holes 30 in the support projections 26 from the side of the insulation displacement terminal portions 40. Amounts of inserting the tab-like terminal 28*a* and tuning fork-like terminal 28*c* into the support portions 26*a* and 26*c* are determined by contacting the stoppers 44 and 44 with step-like latching surfaces 48 and 48 provided in the support projections 26*a* and 26*c*. Although the pin-like terminal 28*b* is not illustrated in detail in FIG. 4, the pin-like terminal 28*b* is provided on its suitable positions with projection piece-like stoppers. An amount of inserting the pin-like terminal 28*b* into the support projection 26*b* is determined by contacting the stoppers with step-like latching surfaces provided in the support projections 26*b*.

When the connecting terminals 28 are inserted into the through-holes 30 in the support projections 26, the connecting terminals 28 are supported by the support projections 26. While the connecting terminals 28 are inserted in the support projections 26, the terminal portions 38 protrude from the support projections 26. On the other hand, the insulation displacement terminal portions 40 protrude via the through-holes 30 from the rear side 32 of the insulation plate 20 and are inserted into the receiving grooves 36 for the insulation displacement terminal portions provided on the pinching projections 34, 34. The sheathed wire 50 are disposed between the pinching projections 34, 34 to be pinched by the pinching ribs 35, 35, and the sheathed wire 50 is arranged on the rear side 32 of the insulation plate 20. When the insulation displacement terminal portions 40 of the connecting terminals 28 are inserted into the spaces between the pinching projections 34, 34, the sheathed wire 50 disposed between the pinching projections 34, 34 are inserted into the space between the insulation displacement blades 42, 42 of the insulation displacement terminal portions 40, and an insulation sheath of the sheathed wire 50 is removed by the insulation displacement blades 42, 42. Thus, the sheathed wire 50 is pressed onto the insulation displacement terminal portions 40 to be electrically coupled to the connecting terminals 28.

It will be apparent from FIG. 4 that dimensions in length (upper and lower directions in FIG. 4) of the tab-like terminals 28*a*, pin-like terminals 28*b*, and tuning fork-like terminals 28*c* are different from one another. However, even if the sheathed wire 50 is arranged at the rear side 32 of any one of the support projections 26*a*, 26*b*, and 26*c*, the sheathed wire 50 is disposed on the substantially same positions in a thickness direction of the insulation plate 20 (upper and lower directions in FIG. 4) and is connected to the insulation displacement terminal portions 40 of the connecting terminals 28. Consequently, the tab-like terminals 28*a*, pin-like terminals 28*b*, and tuning fork-like terminals 28*c* have different dimensions in length, protruding dimensions of the terminals 28*a* to 28*c* that protrude from the front side 24 of the insulation plate 20 are different from one another, and positions in height of the terminals 28*a* to 28*c* from the front sides 24 of the stoppers 44 are different from one another. In order to stably support the tab-like terminals 28*a*, pin-like terminals

28*b*, and tuning fork-like terminals 28*c* by means of latch actions of the stoppers 44, the protruding dimensions of the terminals 28*a* to 28*c* from the front sides 24 of the support projections 26*a* to 26*c* are set to be different from one another in correspondence with the dimensions in length of the tab-like terminals 28*a*, pin-like terminals 28*b*, and tuning fork-like terminals 28*c*.

Figure 6:
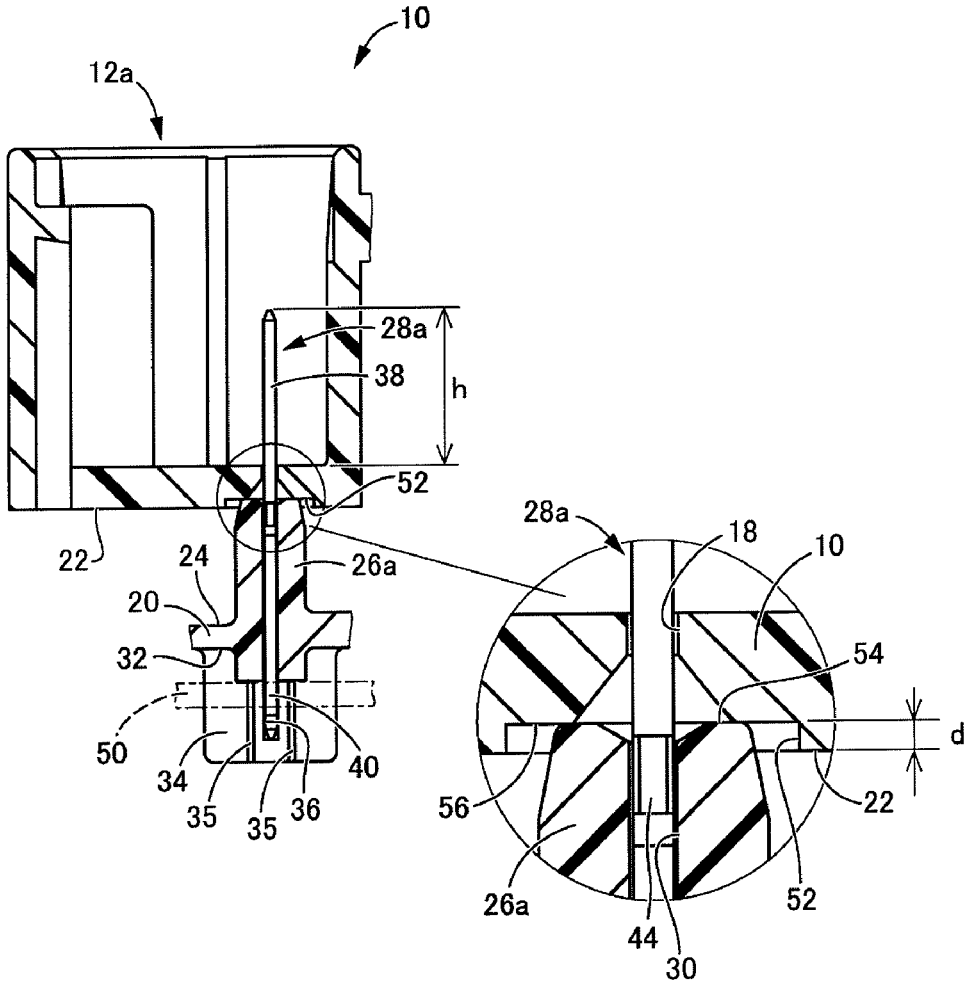
FIG. 6 is a section view of the upper casing and insulation plate taken along lines VI-VI in FIG. 1, illustrating the insulation plate shown in FIG. 3 incorporated with the upper casing shown in FIG. 1.

The insulation plate 20, from which the tab-like terminals 28*a*, pin-like terminals 28*b*, and tuning fork-like terminals 28*c* protrude, is contained in the space between the upper casing 10 and the lower casing (not shown) to form the electrical junction box. FIG. 6 shows an example of a single connector-mounting section 12*a* in the upper casing 10. The terminal portion 38 of the tab-like terminal 28*a* that protrudes from the insulation plate 20 is inserted into the terminal-receiving hole 18 provided in the connector-mounting section 12, and the terminal portion 38 protrudes to an exterior of the upper casing 10 at the connector-mounting section 12.

A projection amount h of the tab-like terminal 28*a* protruding from the upper casing 10 must be set to be a given size in correspondence with a configuration of a connector (not shown). As described above, since a projecting dimension in which the support projection 26*a* that support the tab-like terminal 28*a* protrudes from the front side 24 of the insulation plate 20 is defined in correspondence with a configuration of the tab-like terminal 28*a*, a projection end surface 54 of the support projection 26*a* will interfere with the inner surface 22 of the upper casing 10 in the first embodiment, if the projection amount h of the tab-like terminal 28*a* must be obtained. Accordingly, a recess-like matching portion 52 is provided around the terminal-receiving hole 18 in the upper casing 10. The matching portion 52 is provided on a surface of the upper casing 10 to be opposed to the projection end surface 54 of the support projection 26*a* to be depressed from the inner surface 22. A bottom surface 56 of the matching portion 52 is disposed on a forward position from the inner surface 22 in a projecting direction of the tab-like terminal 28*a* (upward direction in FIG. 6). When the support projection 26 is inserted into the matching portion 52 and the projection end surface 54 of the support projection 26 contacts with the bottom surface 56 of the matching portion 52, the projection end surface 54 is positioned in the upper casing 10 in the projecting direction of the tab-like terminal 28*a*. Thus, the projection end surface 54 is disposed on the forward position from the inner surface 22 of the upper casing 10 in the projecting direction of the tab-like terminal 28*a* to define the projecting dimension h of the tab-like terminal 28*a*.

Figure 7:
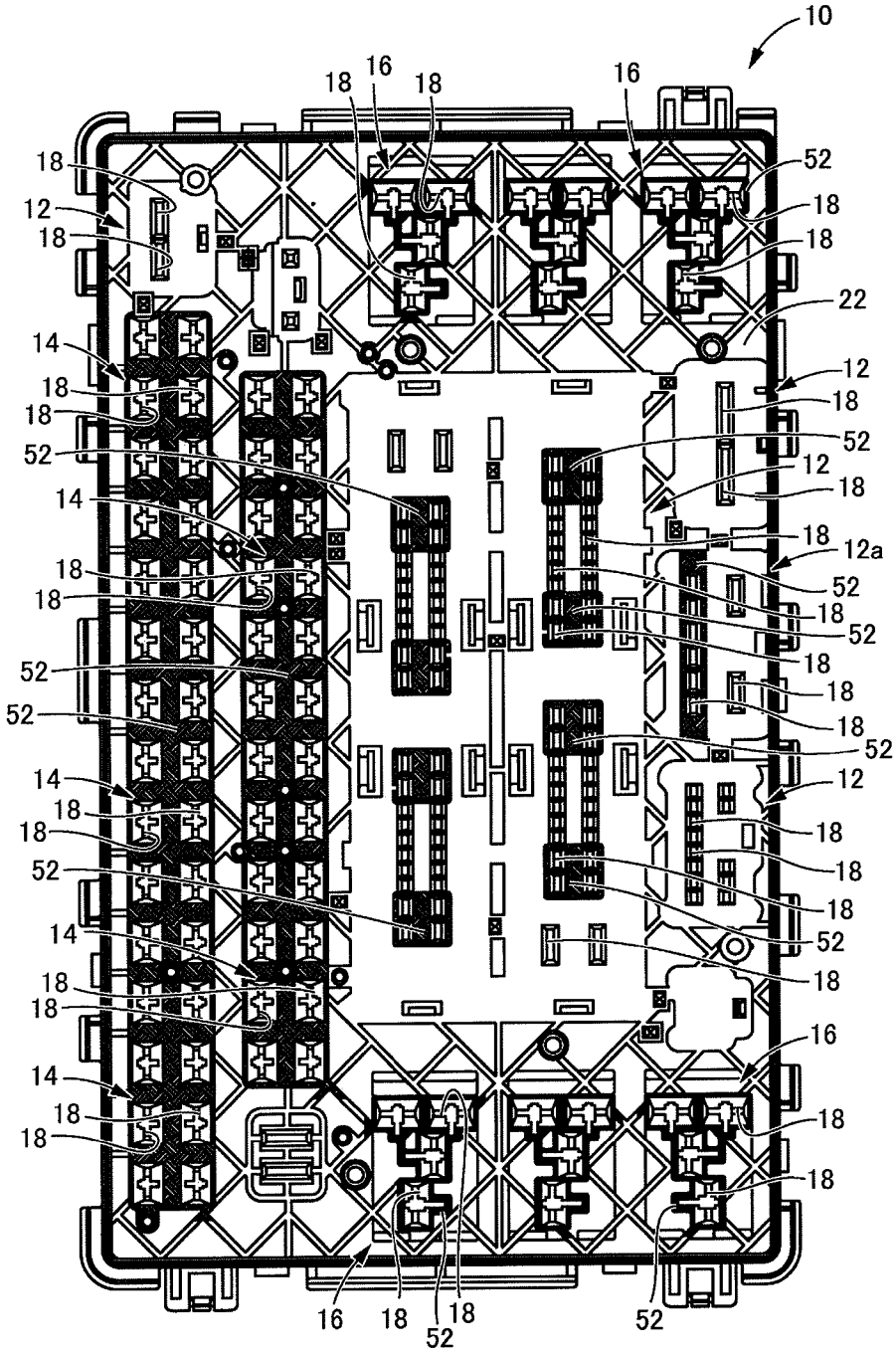
FIG. 7 is a plan view of an inner surface of the upper casing shown in FIG. 2, illustrating formed positions of matching portions.

As shown in an area colored in black in FIG. 7, the recess-like matching portions 52 are provided in the inner surface 22 of the upper casing 10 around the terminal-receiving holes 18 in the connector-mounting sections 12, fuse-mounting sections 14, and relay-mounting sections 16. Although the pin-like terminal 28*b* is omitted in the drawings, the support projection 26*b* that supports the pin-like terminal 28*b* is inserted into the recess-like matching portion 52 provided in the connector-mounting section 12 to obtain an outward projection amount of the pin-like terminal 28*b* from the upper casing 10, as is the case with the recess-like matching portion 52 provided in the connector-mounting section 12. Similarly, when the support projection 26*c* that supports the tuning fork-like terminal 28*c* is inserted into the recess-like matching portion 52 provided in the fuse-mounting section 14 or the fuse-mounting section 16, an outward projection amount of the tuning fork-like terminal 28*c* from the upper casing 10 can be obtained.

According to the first embodiment, it is possible to set the projection amount h of the tab-like terminal 28*a* from the upper casing 10 to be a desired size while avoiding an interference between the support projection 26*a* and the upper casing 10 by adjusting a dimension d in depth (see FIG. 6) of the recess-like matching portion 52 from the inner surface 22. Thus, it is possible to set the desired projecting dimension by using the connecting terminals 28 to be utilized for another electrical junction box while restraining the interference between the upper casing 10 and the insulation plate 20. In result, it is not necessary to produce new connecting terminals 28, to prevent a parts control number from increasing, and to lower a cost in production.

In particular, the projection end surface 54 of the support projection 26 contacts with the bottom surface 56 of the recess-like matching portion 52. Thus, it is possible to stably position the support projection 26 on the upper casing 10 and to precisely and stably set the outward projecting dimension of the connecting terminal 28, which protrudes from the support projection 26, from the upper casing 10. Furthermore, it is possible to set the outward projecting dimensions of the respective connecting terminals 28 from the upper casing 10 to be the desired sizes without changing the contact positions between the respective connecting terminals 28 and the sheathed wire 50 on the insulation plate 20 merely by adjusting the dimensions in depth of the matching portions 52. Thus, it is possible to set the projection amount of the support projection 26 in correspondence with a specification of an electrical component to be connected to the connecting terminal 28 by using the already available insulation plate 20 and connecting terminal 28, without involving a design change of the insulation plate 20. The recess-like matching portion 52 can be readily formed by combining a bush with a mold that forms the upper casing 10, thereby cheaply forming the matching portion 52 by utilizing already-existing parts or instruments.

Figure 8:
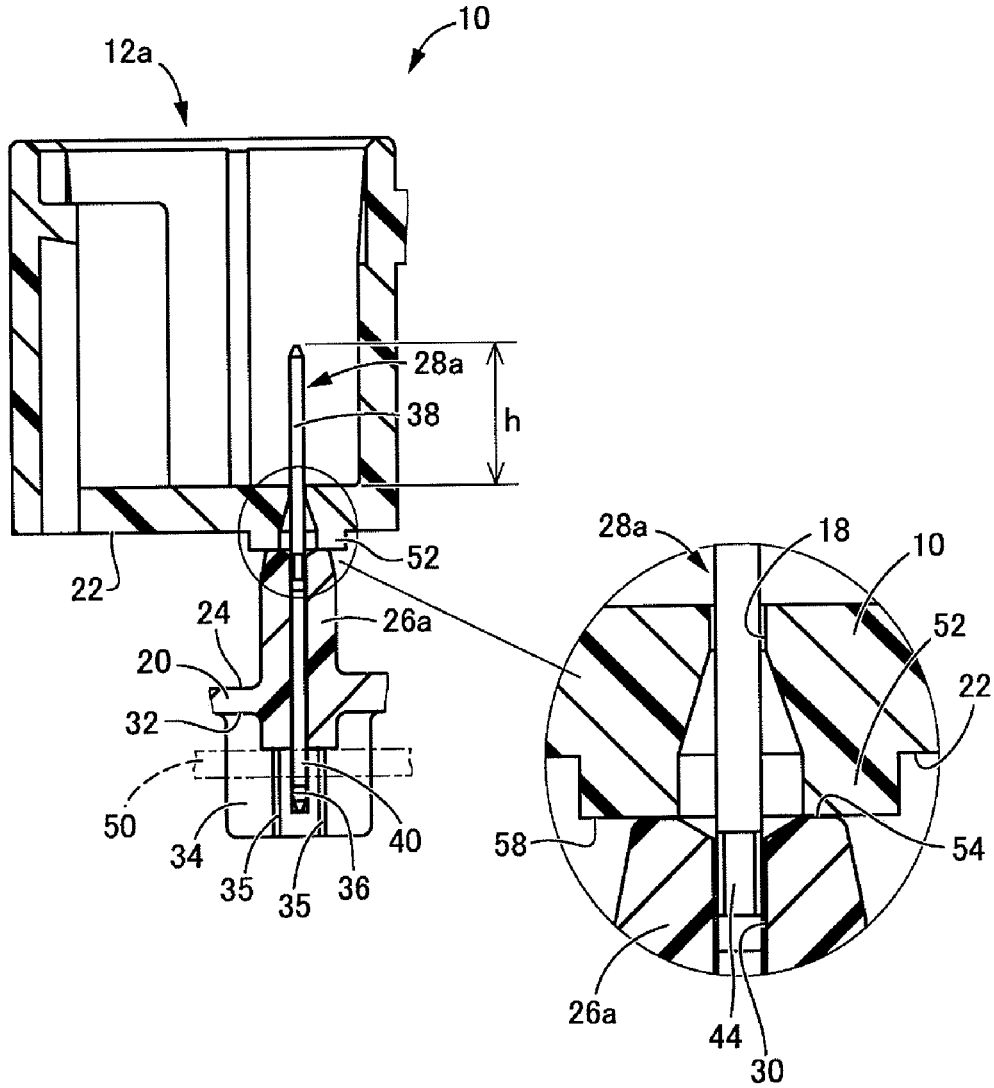
FIG. 8 is a section view similar to FIG. 6, illustrating a second embodiment of the electrical junction box in which the insulation plate is incorporated with the upper casing.

FIG. 8 shows a second embodiment of the electrical junction box in accordance with the present invention. The matching portion 52 may be not only the depressed recess configuration shown in FIG. 6 but also a bump configuration shown in FIG. 8. The matching projection 52 in the second embodiment protrudes from the inner surface 22 of the upper casing 10 at the same position in the connector-mounting section 12*a* shown in FIG. 6. In FIG. 8, explanations about the same members and positions in the second embodiment as those in the first embodiment are omitted here by giving the same signs to them.

That is, under an assembling condition between the upper casing 10 and the insulation plate 20, in the case where the projecting dimension h of the tab-like terminal 28*a* from the upper casing 10 must be set to be a desired size, the projection end surface 54 of the support projection 26*a* may be spaced apart from the inner surface 22 of the upper casing 10. Accordingly, the bump-like matching portion 52 is provided on a surface opposed to the projection end surface 54 in the inner surface 22 in the second embodiment. Thus, a contact position between the projection end surface 54 of the support projection 26*a* and the upper casing 10 is disposed at a backward position from the inner surface 22 (downward in FIG. 8) in a projecting direction of the tab-like terminal 28*a*. When the projection end surface 54 of the support projection 26*a* contacts with a top surface 58 of the matching portion 52, the support projection 26*a* is positioned on the upper casing 10.

In the case where the projecting dimension h of the tab-like terminal 28*a* from the upper casing 10 is set to be a desired size and the support projection 26*a* is spaced apart from the upper casing 10, it is possible for the second embodiment to bring the support projection 26*a* into contact with the upper casing 10 through the bump-like matching portion 52. Thus, it is possible to reduce a relative shift between the support projection 26*a* and the upper casing 10, thereby stably supporting the tab-like terminal 28*a* in the upper casing 10.

Although the embodiments of the present invention are described above in detail, it should be noted that the present invention is not limited to the above embodiments. For example, a recess-like matching portion and a bump-like matching portion may be provided on a single casing, as a matter of course.

It is possible to utilize connecting terminals known in the prior art or various kinds of connecting terminal that have been produced for other electrical junction box. Specific configurations of the connecting terminals of the present invention are not limited to the above embodiments.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

What is claimed is:

1. An electrical junction box comprising:

a casing having terminal-receiving holes;

an insulation plate contained in said casing; and a plurality of connecting terminals protruding from said insulation plate and protruding outward from said casing through said terminal-receiving holes, wherein said insulation plate includes support projections having projecting dimensions corresponding with said connecting terminals, said connecting terminals being fitted into and held in said support projections, wherein said casing is provided on a surface opposed to said support projections with recess or bump matching portions, said matching portions contacting with projection end surfaces of said support projections to position said support projections.

2. An electrical junction box according to claim 1, wherein a sheathed wire is arranged on said insulation plate, said connecting terminals are provided on proximal ends with insulation displacement terminal portions, and said sheathed wire is pressed onto said insulation displacement terminal portions.

* * * * *